US009697765B2

(12) United States Patent
Chung et al.

(10) Patent No.: US 9,697,765 B2
(45) Date of Patent: Jul. 4, 2017

(54) ORGANIC LIGHT EMITTING DISPLAY AND METHOD FOR DRIVING THE SAME

(71) Applicant: SAMSUNG DISPLAY CO., LTD., Yongin, Gyeonggi-Do (KR)

(72) Inventors: Gun-Hee Chung, Yongin (KR); Hyun-Seuk Yoo, Yongin (KR); Jong-Woong Park, Yongin (KR); Joo-Hyung Lee, Yongin (KR); Chang-Kyu Seol, Yongin (KR); Jun-Jin Kong, Yongin (KR); Hong-Rak Son, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 96 days.

(21) Appl. No.: 14/633,047

(22) Filed: Feb. 26, 2015

(65) Prior Publication Data

US 2015/0243201 A1 Aug. 27, 2015

(30) Foreign Application Priority Data

Feb. 26, 2014 (KR) ..... 10-2014-0022511

(51) Int. Cl.
*G09G 3/32* (2016.01)
*G09G 3/3225* (2016.01)

(52) U.S. Cl.
CPC ..... *G09G 3/3225* (2013.01); *G09G 2320/043* (2013.01); *G09G 2340/02* (2013.01); *G09G 2360/16* (2013.01)

(58) Field of Classification Search
CPC ..... G09G 3/3225; G09G 2320/043; G09G 2340/02; G09G 2360/16
See application file for complete search history.

(56) References Cited

U.S. PATENT DOCUMENTS

2006/0279490 A1 12/2006 Park et al.
2007/0098283 A1* 5/2007 Kim ..... H04N 19/176 382/239
2010/0303149 A1* 12/2010 Yasuda ..... H04N 19/176 375/240.03
2013/0063458 A1 3/2013 Shido et al.
(Continued)

FOREIGN PATENT DOCUMENTS

JP 2013-57912 A 3/2013
KR 10-2012-0033401 A 4/2012
KR 10-2012-0033402 A 4/2012

*Primary Examiner* — Sahlu Okebato
(74) *Attorney, Agent, or Firm* — Lewis Roca Rothgerber Christie LLP

(57) ABSTRACT

An organic light emitting display and a method for driving the organic light emitting display. The organic light emitting display includes a display unit, a data accumulator, and a data compensator. The display unit is configured to be driven by image data. The data accumulator is configured to compress and accumulate first data corresponding to a first portion of the image data for driving a first region of the display unit, identify a second region of the display unit from the first region by analyzing the accumulated first data, and compress and accumulate second data corresponding to a second portion of the image data for driving the second region with a compression ratio based on a size of the second region. The data compensator is configured to compensate the image data based on the accumulated first and second data.

14 Claims, 4 Drawing Sheets

(56) References Cited

U.S. PATENT DOCUMENTS

| | | | | |
|---|---|---|---|---|
| 2014/0184671 | A1* | 7/2014 | Lee | G09G 3/006 345/697 |
| 2015/0187328 | A1 | 7/2015 | Kim et al. | |
| 2015/0194096 | A1 | 7/2015 | Chung et al. | |

* cited by examiner $$\begin{bmatrix} S_{11} & S_{12} & S_{13} & S_{14} \\ S_{21} & S_{22} & S_{23} & S_{24} \\ S_{31} & S_{32} & S_{33} & S_{34} \\ S_{41} & S_{42} & S_{43} & S_{44} \end{bmatrix} \cdot T = \begin{bmatrix} C_{11} & C_{12} & C_{13} & C_{14} \\ C_{21} & C_{22} & C_{23} & C_{24} \\ C_{31} & C_{32} & C_{33} & C_{34} \\ C_{41} & C_{42} & C_{43} & C_{44} \end{bmatrix}$$

$$\begin{bmatrix} C_{11} & C_{12} & C_{13} & C_{14} \\ C_{21} & C_{22} & C_{23} & C_{24} \\ C_{31} & C_{32} & C_{33} & C_{34} \\ C_{41} & C_{42} & C_{43} & C_{44} \end{bmatrix} \Rightarrow \begin{bmatrix} C_{a1b1} & C_{a1b2} \\ C_{a2b1} & C_{a2b2} \end{bmatrix}$$

ORGANIC LIGHT EMITTING DISPLAY AND METHOD FOR DRIVING THE SAME

CROSS-REFERENCE TO RELATED APPLICATION

This application claims priority to and the benefit of Korean Patent Application No. 10-2014-0022511, filed on Feb. 26, 2014 in the Korean Intellectual Property Office, the entire content of which is incorporated herein by reference.

BACKGROUND

1. Field

Aspects of embodiments of the present invention relate to an organic light emitting display and a method for driving the organic light emitting display.

2. Description of the Related Art

Recently, there have been developed various types of flat panel displays having reduced weight and volume compared to those of cathode ray tube devices. Flat panel displays include liquid crystal displays, field emission displays, plasma display panels, organic light emitting displays, and the like. Among these flat panel displays, organic light emitting displays display images using organic light emitting diodes (OLEDs) that emit light through recombination of electrons and holes. Organic light emitting displays have a fast response speed and are driven with low power consumption. An organic light emitting display includes a display unit having a plurality of pixels respectively disposed at crossing regions of scan lines and data lines. Each pixel has an OLED that emits a luminance corresponding to a data signal, and accordingly, an image is displayed on the display unit.

SUMMARY

Embodiments of the present invention provide for an organic light emitting display and a method for driving the organic light emitting display, which can compensate for degradation of pixels by efficiently accumulating stress data corresponding to the light emission amount of the pixels.

According to an embodiment of the present invention, an organic light emitting display is provided. The organic light emitting display includes: a display unit configured to be driven by image data; a data accumulator configured to compress and accumulate first data corresponding to a first portion of the image data for driving a first region of the display unit, identify a second region of the display unit from the first region by analyzing the accumulated first data, and compress and accumulate second data corresponding to a second portion of the image data for driving the second region with a compression ratio based on a size of the second region; and a data compensator configured to compensate the image data based on the accumulated first and second data.

The data accumulator may include: a controller configured to identify the second region by analyzing the accumulated first data, and determine the compression ratio based on the size of the second region; a gray-stress converter configured to generate the first and second data by converting gray levels included in the first and second portions of the image data into stress values constituting the first and second data, respectively; a first compressor configured to compress the first data using a lossy compression method; a second compressor configured to compress the second data based on the compression ratio; and a memory configured to accumulate and store the compressed first and second data as the accumulated first and second data, respectively.

The gray-stress converter may be further configured to convert the gray levels into the stress values by mapping each of the gray levels to a corresponding one of the stress values using a mapping table.

The first compressor may be further configured to compress the first data by dividing the display unit into a plurality of blocks, transforming ones of the stress values corresponding to each of the blocks into a frequency region including a plurality of frequency components, and extracting ones of the frequency components.

The controller may be further configured to incorporate one of the blocks into the second region when a sum of high-frequency ones of the frequency components in the frequency region of the one of the blocks exceeds a reference value.

The controller may be further configured to control the compression ratio based on a number of the blocks incorporated into the second region.

The second compressor may be further configured to compress the second portion using one of a plurality of compression units that compress the second portion with a corresponding plurality of different compression ratios, as selected by the controller.

A compression ratio of the first compressor may be greater than the compression ratio of the second compressor.

The data compensator may be further configured to calculate compensation values with respect to pixels based on the accumulated first and second data, and compensate the image data based on the calculated compensation values.

According to another embodiment of the present invention, a method for driving an organic light emitting display is provided. The organic light emitting display includes a display unit. The method includes: generating first data by converting gray levels included in a first portion of image data into stress values, the first portion for driving a first region of the display unit; compressing the first data using a first compression method, and accumulating and storing the compressed first data in a first partition of a memory; identifying a second region of the display unit from the first region by analyzing values stored in the first partition; determining a compression ratio based on a size of the second region; generating second data by converting gray levels included in a second portion of the image data into stress values, the second portion for driving the second region of the display unit; compressing the second data based on the determined compression ratio, and accumulating and storing the compressed second data in a second partition of the memory; and compensating the image data based on values stored in the memory.

The generating of the first and second data may include converting the gray levels into corresponding said stress values by mapping each one of the gray levels to a corresponding one of the stress values using a mapping table.

The accumulating and storing of the compressed first data in the first partition of the memory may include: dividing the display unit into a plurality of blocks; transforming ones of the stress values corresponding to each of the blocks into a frequency region including a plurality of frequency components; extracting ones of the frequency components in the frequency region; and accumulating the extracted frequency components in the first partition of the memory.

The identifying of the second region may further include incorporating one of the blocks into the second region when a sum of high-frequency ones of the frequency components in the frequency region of the one of the blocks exceeds a reference value.

The compression ratio may be based on a number of the blocks incorporated into the second region.

The compensating of the image data may include calculating compensation values with respect to pixels based on the values stored in the memory, and compensating the image data based on the calculated compensation values.

BRIEF DESCRIPTION OF THE DRAWINGS

Example embodiments will now be described more fully hereinafter with reference to the accompanying drawings; however, the invention may be embodied in different forms and should not be construed as limited to the embodiments set forth herein. Rather, these embodiments are provided so that this disclosure will more fully convey the scope of the present invention to those skilled in the art.

In the drawings, dimensions may be exaggerated for clarity of illustration. It will be understood that when an element is referred to as being "between" two elements, it may be the only element between the two elements, or one or more intervening elements may also be present. Like reference numerals refer to like elements throughout.

DETAILED DESCRIPTION

Figure 1:
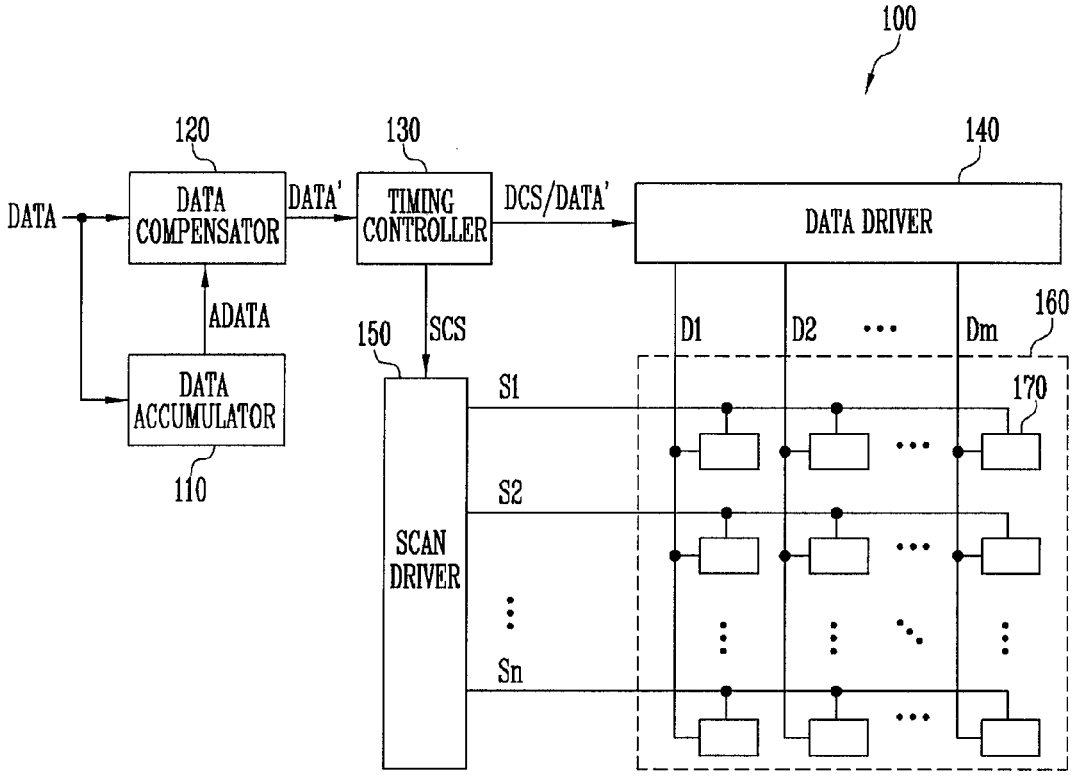
FIG. 1 is a block diagram schematically illustrating an organic light emitting display according to an embodiment of the present invention.

Hereinafter, certain exemplary embodiments according to the present invention will be described with reference to the accompanying drawings. Here, when a first element is described as being coupled to a second element, the first element may be not only directly coupled to the second element but may also be indirectly coupled to the second element via one or more third elements. Further, some of the elements that are not essential to the complete understanding of the invention may be omitted for clarity. In addition, like reference numerals refer to like elements throughout.

Herein, the use of the term "may," when describing embodiments of the present invention, refers to "one or more embodiments of the present invention." In addition, the use of alternative language, such as "or," when describing embodiments of the present invention, refers to "one or more embodiments of the present invention" for each corresponding item listed.

FIG. 1 is a block diagram schematically illustrating an organic light emitting display 100 according to an embodiment of the present invention.

Referring to FIG. 1, the organic light emitting display 100 includes a data accumulator 110, a data compensator 120, a timing controller 130, a data driver 140, a scan driver 150, and a display unit 160 that includes pixels 170. The data accumulator 110 generates accumulated data ADATA by accumulating (for example, summing) image data DATA (for example, brightness levels, or corresponding pixel stress data SDATA derived from the image data DATA) supplied from an outside source, e.g., an application processor of a host. This accumulation may take place, for example, on a pixel-by-pixel basis, or by groups of pixels (such as by regions of the display unit 160). The accumulated data ADATA provides an indication of how hard a particular pixel 170 or region of the display unit 160 has been stressed or driven over time from the accumulated values (e.g., brightness levels, stress values).

The accumulated data ADATA may be useful for compensating the image data DATA to account for general image degradation over time or localized image degradation due to excessive stress (e.g., more frequent driving or more intense driving) in some pixels 170 or regions of the display unit 160 compared to that of others. However, the accumulated data ADATA may take on a large size over time, depending on factors such as the granularity of the accumulation (e.g., pixel-by-pixel, frame-by-frame, etc.) Accordingly, lossy compression may be used to reduce the size of the image or stress data being accumulated, at the expense of losing some of the accuracy of the accumulations.

To this end, the data accumulator 110 analyzes the accumulated data ADATA, and identifies a region or regions of the display unit 160 (namely, degradation compensation regions, such as a logo boundary region) for more precise degradation compensation based on the analyzed result. For example, the degradation compensation regions may represent those portions of the display unit 160 whose degradation (or whose compensation of the degradation) would be more noticeable (e.g., inaccurate, unintended) if the corresponding image data DATA or stress data SDATA was compressed or highly compressed (as opposed to being uncompressed or only lightly compressed).

In this specification, a 'degradation compensation region' refers to a region of the display unit 160 for which a higher degradation compensation accuracy is desired compared to that of other regions of the display unit 160. That is, a region of the display unit 160 for which degradation degree rapidly changes as compared to other regions in the display unit 160 is referred to as a 'degradation compensation region'. Further, for ease of description, throughout the present specification, there may be more than one such degradation compensation region, or multiple such regions may be referred to in aggregate as if they were a single degradation compensation region.

For example, a region of the display unit 160 in which an identical or similar image is continuously displayed (such as a logo) degrades differently from other regions whose corresponding images are continuously changing. As such, the degradation may be viewed at a boundary (such as a logo boundary) between the continuously displayed region and the continuously changing regions, where the degradation degree rapidly changes. According to embodiments of the present invention, the accuracy of degradation compensation at the boundary increases as compared to other regions.

Further, the data accumulator 110 determines a compression ratio of a portion of the image data DATA (or corresponding stress data SDATA) corresponding to the degradation compensation region based on the size of the degradation compensation region or regions. The data accumulator 110 compresses and accumulates the portion of the image data DATA or stress data SDATA corresponding to the degradation compensation regions based on the determined compression ratio. Compression of the image data DATA or stress data SDATA may, for example, significantly increase the quantity of image or stress data that may be accumulated (at the expense of possibly affecting the accuracy of this accumulation).

For example, when the size of the degradation compensation region is small, the data accumulator 110 compresses the portion of the image data DATA or stress data SDATA corresponding to the degradation compensation region without any loss (i.e., lossless compression), or does not compress the portion but instead accumulates the portion as it is. As the size of (or number of) the degradation compensation regions gradually increases, the data accumulator 110 increases the compression ratio of the portion of the image data DATA or stress data SDATA corresponding to the degradation compensation region or regions.

The data accumulator 110 also compresses and accumulates a portion of the image data DATA or stress data SDATA not corresponding to the degradation compensation region using a set or predetermined lossy compression method, for example, a lossy compression method having a constant compression ratio (such as a high compression ratio). Here, a "lossy compression method" refers to a method that may, for example, use inexact approximations (such as partial data discarding) to represent content that has been encoded. Thus, unlike a lossless compression method (which can recreate the original uncompressed data without loss), a lossy compression method may achieve substantially better compression ratios by, for example, keeping frequently occurring values while discarding infrequently occurring values and thus, not be able to recreate the original uncompressed data without loss.

The compression ratio with respect to the portion of the image data DATA or stress data SDATA corresponding to the degradation compensation region is lower (e.g., not as compressed) than that of the portion of the image data DATA or stress data SDATA not corresponding to the degradation compensation region. Thus, the portion of the image data DATA or stress data SDATA corresponding to the degradation compensation region in the accumulated data ADATA has a higher accuracy (such as a much higher accuracy) than the portion of the image data DATA or stress data SDATA not corresponding to the degradation compensation region. The data compensator 120 compensates the image data DATA based on the accumulated data ADATA and thus, the portion of the image data DATA corresponding to the degradation compensation region may be more accurately compensated.

The data accumulator 110 may accumulate the image data DATA for each frame. However, the data accumulator 110 may not necessarily be driven at a high enough speed to accumulate for each frame. Accordingly, for example, the data accumulator 110 may be set to compress the image data DATA for every set or predetermined frame (such as every other frame, or every Nth frame for some N>2). The data accumulator 110 supplies the accumulated data ADATA to the data compensator 120. The structure and operation of the data accumulator 110 will be described further below with reference to FIGS. 2 and 3.

The data compensator 120 compensates the image data DATA based on the accumulated data ADATA supplied from the data accumulator 110, and supplies the compensated image data DATA' to the timing controller 130. For example, the data compensator 120 may increase pixel values (e.g., gray levels) corresponding to pixels 170 whose accumulated stress or degradation is relatively (or absolutely) high based on the accumulated data ADATA (e.g., those pixels 170 that have likely degraded over time from a relatively large amount of total brightness displayed or accumulated stress), and may decrease pixel values corresponding to pixels 170 whose accumulated stress or degradation is relatively (or absolutely) low based on the accumulated data ADATA. The structure and operation of the data compensator 120 will be described further below with reference to FIG. 4.

The timing controller 130 controls operations of the data driver 140 and the scan driver 150 in response to a synchronization signal or signals supplied from an outside source thereof. For example, the timing controller 130 may generate data driving control signals DCS and supply the generated data driving control signals DCS to the data driver 140. In addition, the timing controller 130 may generate scan driving control signals SCS and supply the generated scan driving control signals SCS to the scan driver 150. The timing controller 130 supplies the compensated image data DATA' received from the data compensator 120 to the data driver 140.

Although the data accumulator 110, the data compensator 120, and the timing controller 130 are separately shown in FIG. 1, the present invention is not limited thereto. For example, in some embodiments, the data accumulator 110, the data compensator 120, and the timing controller 130 may be implemented with one circuit.

The data driver 140 realigns the compensated image data DATA' supplied from the timing controller 130 in response to the data driving control signals DCS output from the timing controller 130, and supplies the realigned image data as data signals to data lines D1 to Dm. The scan driver 150 sequentially supplies a scan signal to scan lines S1 to Sn in response to the scan driving control signals SCS output from the timing controller 130.

The display unit 160 includes pixels 170 respectively disposed at crossing regions or intersection portions of the data lines D1 to Dm and the scan lines S1 to Sn. Here, the data lines D1 to Dm are arranged along vertical lines, and the scan lines S1 to Sn are arranged along horizontal lines. Each pixel 170 emits light with a luminance corresponding to a data signal supplied through a corresponding data line among the data lines D1 to Dm when a scan signal is supplied through a corresponding scan line among the scan lines S1 to Sn.

Figure 2:
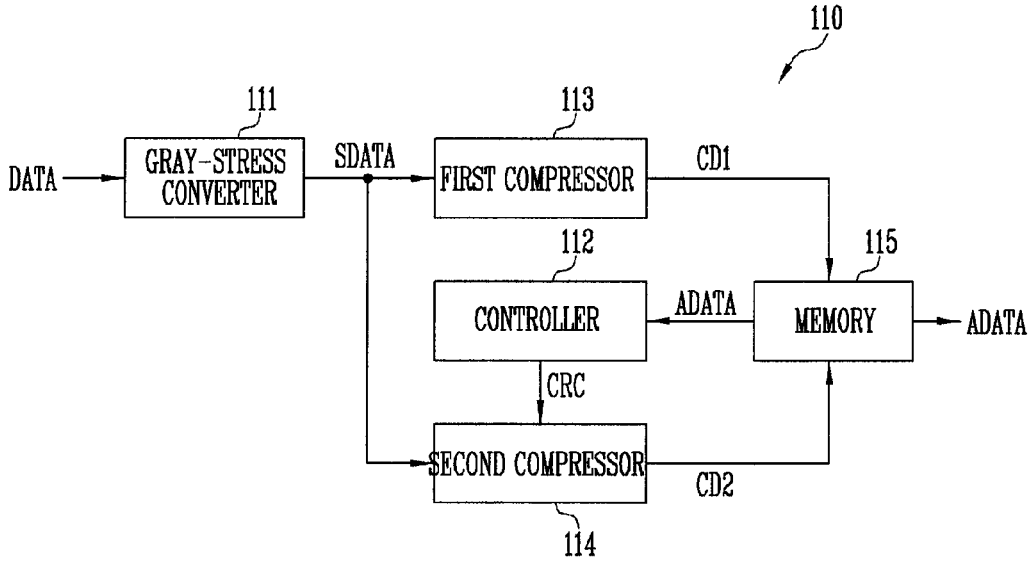
FIG. 2 is a block diagram illustrating a data accumulator shown in FIG. 1.
Figure 3:
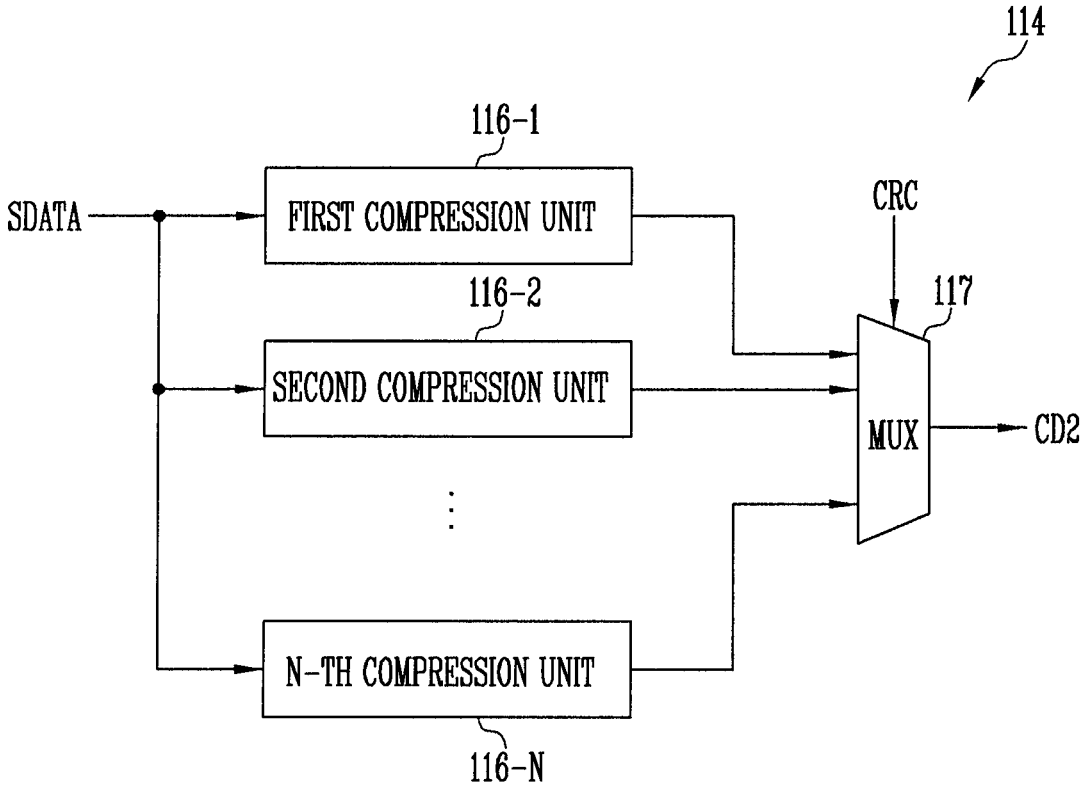
FIG. 3 is a block diagram illustrating a second compressor shown in FIG. 2.
Figures 4A, 4B, 5:
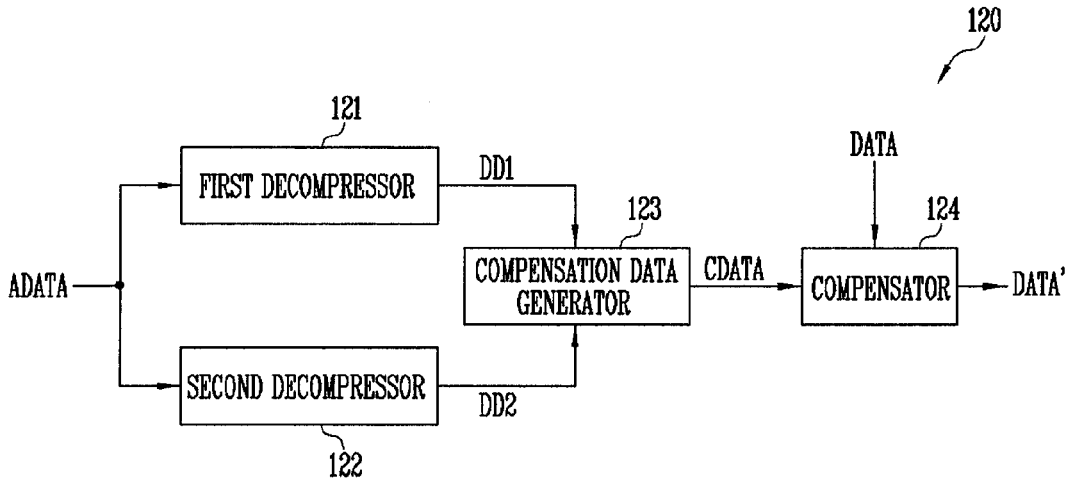
FIGS. 4A and 4B are diagrams illustrating example generation and compression processes of stress data as may be performed by the data accumulator shown in FIG. 2.
FIG. 5 is a block diagram illustrating a data compensator shown in FIG. 1.

FIG. 2 is a block diagram illustrating the data accumulator 110 shown in FIG. 1. FIG. 3 is a block diagram illustrating a second compressor 114 shown in FIG. 2. FIGS. 4A and 4B are diagrams illustrating example generation and compression processes of stress data as may be performed by the data accumulator 110 shown in FIG. 2.

Referring to FIGS. 2 to 4B, the data accumulator 110 includes a gray-stress converter 111, a controller 112, a first compressor 113, a second compressor 114, and a memory 115. The gray-stress converter 111 generates stress data SDATA by converting gray scale values (e.g., gray levels or brightness levels) included in the image data DATA into stress values. For example, the gray-stress converter 111 may convert gray scale values corresponding to the pixels 170 into stress values corresponding to the pixels 170 by mapping each gray scale value to a corresponding stress value using a set or predetermined mapping table.

The gray scale values supplied to the pixels 170 and the corresponding degradation degree (e.g., wear and tear) of the pixels 170 may not be exactly in proportion to each other and therefore, the gray-stress converter 111 converts the gray scale values into the stress values. The set or predetermined mapping table may be previously determined by an experiment, etc., as would be apparent to one of ordinary skill, and may change depending on factors such as the process, materials, or structure used for the pixels 170.

The controller 112 analyzes the accumulated data ADATA stored in the memory 115 and identifies a degradation compensation region based on the analyzed result. The controller 112 determines a compression ratio with respect to a second portion of the stress data SDATA corresponding to the identified degradation compensation region based on the size of the degradation compensation region. The controller 112 supplies, to the second compressor 114, a compression ratio control signal CRC including position information and compression ratio information of the degradation compensation region.

For convenience of illustration, the specific operation of the controller 112 will be described after operations of the data accumulator 110 and other components are described.

The first compressor 113 compresses a first portion of the stress data SDATA not corresponding to the degradation compensation region using a set or predetermined lossy compression method. Since the first portion of the stress data SDATA does not correspond to the degradation compensation region, the first portion is not as significant an influence on the overall degradation compensation as that of the degradation compensation region. Accordingly, the accuracy of degradation compensation may be maintained even though stress values corresponding to the first portion of the stress data SDATA are compressed and stored using a lossy compression method.

The first compressor 113 may divide the display unit 160 into a plurality of blocks, and perform compression (for example, lossy compression) on each of the blocks. For example, each block may represent those pixels 170 in a particular region or portion of the display unit 160. In some embodiments, the first compressor 113 transforms stress values (from among the stress data SDATA) corresponding to each of the blocks into frequency values making up a frequency region. For example, the first compressor 113 may transform stress values into a frequency region through a discrete cosine transformation (DCT), Hadamard transform, Haar transform, etc., as would be apparent to one of ordinary skill.

By way of example, the stress data SDATA may be organized in blocks, each of which contains 16 values (for 16 corresponding pixels), such as stress values $S_{11}$ to $S_{44}$ shown in FIG. 4A. The first compressor 113 may generate a corresponding matrix of frequency values $C_{11}$ to $C_{44}$ (such as the stress values $S_{11}$ to $S_{44}$ transformed into a frequency region) by multiplying a matrix configured with the stress values $S_{11}$ to $S_{44}$ by a transform matrix T, or perform some other operation to convert the matrix of stress values $S_{11}$ to $S_{44}$ into the corresponding matrix of frequency values $C_{11}$ to $C_{44}$ via the corresponding transform (e.g., DCT, Hadamard transform, Haar transform, etc.) as would be apparent to one of ordinary skill.

Subsequently, the first compressor 113, as shown in FIG. 4B, extracts only specific frequency components $C_{a1b1}$, $C_{a1b2}$, $C_{a2b1}$, and $C_{a2b2}$ from the frequency values $C_{11}$ to $C_{44}$ of the frequency region to increase or further increase the compression ratio. For example, for blocks of 16 stress values $S_{11}$ to $S_{44}$ transformed into 16 frequency values $C_{11}$ to $C_{44}$ via the corresponding transform, four specific frequency components $C_{a1b1}$, $C_{a1b2}$, $C_{a2b1}$, and $C_{a2b2}$ from the frequency values $C_{11}$ to $C_{44}$ may be selected.

Here, the number of and the specific frequency components $C_{a1b1}$, $C_{a1b2}$, $C_{a2b1}$, and $C_{a2b2}$ may be determined through an experiment, etc., in consideration of the accuracy of degradation compensation as would be apparent to one of ordinary skill. For example, selecting more specific frequency components may improve the accuracy of degradation compensation at the expense of taking up more storage to track the extra specific frequency components. In order to effectively identify the degradation compensation region, at least one of the specific frequency components should be a high-frequency component.

Referring back to FIG. 2, the first compressor 113 supplies, to the memory 115, the specific frequency components $C_{a1b1}$, $C_{a1b2}$, $C_{a2b1}$, and $C_{a2b2}$ corresponding to each of the blocks as first compressed data CD1 corresponding to the first portion of the stress data SDATA. The first compressed data CD1 may be stored in a first partition of the memory 115.

The second compressor 114 compresses the second portion of the stress data SDATA corresponding to the degradation compensation region in response to the compression ratio control signal CRC supplied from the controller 112. As the stress values corresponding to the second portion of the stress data SDATA are compressed with no loss or with as small a loss as possible, the accuracy of degradation compensation may be increased compared to when the stress values corresponding to the second portion of the stress data SDATA are compressed similarly to those of the first portion of the stress data SDATA as described above.

When the size of the degradation compensation region is small, e.g., when the number of blocks corresponding to the degradation compensation region is small, the second compressor 114 supplies, to the memory 115, the stress values corresponding to the second portion of the stress data SDATA as second compressed data CD2 (for example, the stress values corresponding to the second portion of the stress data SDATA may be stored without compression). The second compressed data CD2 may be stored in a second partition of the memory 115.

When the number of blocks corresponding to the degradation compensation region is large, the second compressor 114 compresses the stress values corresponding to the second portion of the stress data SDATA, and supplies the compressed stress values as the second compressed data CD2 to the memory 115. As the number of blocks corresponding to the degradation compensation region increases, the compression ratio of the second compressor 114 may also increase.

When the compression ratio of the second compressor 114 changes, the second compressor 114 may recompress the values corresponding to the degradation compensation region in the accumulated data ADATA stored in the memory 115, i.e., the values accumulated and stored in the second partition of the memory 115 based on the changed compression ratio.

According to an embodiment, the second compressor 114 may change only the compression ratio while maintaining the same compression method in response to the compression ratio control signal CRC. According to another embodiment, the second compressor 114 may change the compression method itself in response to the compression ratio control signal CRC.

Referring to FIG. 3, the second compressor 114 may include a plurality of compression units 116-1 to 116-N and a multiplexer 117. The compression units 116-1 to 116-N have different compression ratios. Each of the compression units 116-1 to 116-N compresses the second portion of the stress data SDATA corresponding to the degradation compensation region supplied from the gray-stress converter 111, and outputs the compressed stress data. The multiplexer 117 supplies (to the memory 115) any one of output signals of the compression units 116-1 to 116-N as the second compressed data CD2 in response to the compression ratio control signal CRC.

Referring back to FIG. 2, the memory 115 accumulates and stores the first compressed data CD1 supplied from the first compressor 113 and the second compressed data CD2 supplied from the second compressor 114. For example, the memory 115 may be configured with memory cells and a memory controller for reading or writing values stored in the memory cells. The memory 115 allocates or divides the memory cells into first and second partitions thereof. The memory 115 accumulates and stores the first compressed data CD1 in the first partition, and accumulates and stores the second compressed data CD2 in the second partition. That is, the memory 115 is configured with the first partition for accumulating and storing the first compressed data CD1 and the second partition for accumulating and storing the second compressed data CD2.

The controller 112 decides which of the blocks is included in the degradation compensation region based on the accumulated data ADATA stored in the memory 115. In one embodiment, the controller 112 identifies each block (from among the plurality of blocks) in which the sum of high-frequency components in the frequency region exceeds a reference value to be part of the degradation compensation region.

For example, the controller 112 analyzes values stored in the first partition of the memory 115. When the sum of high-frequency components in one of the blocks that is not part of the degradation compensation region is greater than the reference value, the controller 112 may add this block to the degradation compensation region. In addition, the controller 112 analyzes values stored in the second partition of the memory 115. When the sum of high-frequency components in one of the blocks that is part of the degradation compensation region is smaller than the reference value, the controller 112 may remove the block from the degradation compensation region.

FIG. 5 is a block diagram illustrating the data compensator 120 shown in FIG. 1.

The data compensator 120 includes a first decompressor 121, a second decompressor 122, a compensation data generator 123, and a compensator 124. The first decompressor 121 generates first decompressed data DD1 by decompressing values not corresponding to the degradation compensation region, i.e., values stored in the first partition of the memory 115, in the accumulated data ADATA supplied from the data accumulator 110. The first decompressor 121 supplies the first decompressed data DD1 to the compensation data generator 123. The operation of the first decompressor 121 may correspond to a reverse process of the operation of the first compressor 113, as would be apparent to one of ordinary skill.

The second decompressor 122 generates second decompressed data DD2 by decompressing values corresponding to the degradation compensation region, i.e., values stored in the second partition of the memory 115, in the accumulated data ADATA supplied from the data accumulator 110. The second decompressor 122 supplies the second decompressed data DD2 to the compensation data generator 123. The operation of the second decompressor 122 may correspond to a reverse process of the operation of the second compressor 114, as would be apparent to one of ordinary skill.

The compensation data generator 123 generates compensation data CDATA based on the first decompressed data DD1 supplied from the first decompressor 121 and the second decompressed data DD2 supplied from the second decompressor 122. For example, the compensation data generator 123 may calculate an accumulated light emission amount of each pixel 170 based on the first decompressed data DD1 and the second decompressed data DD2, and estimate a degradation degree of each pixel 170 based on the calculated accumulated light emission amount. Then, the compensation data generator 123 may generate compensation data CDATA including compensation values for compensating for the estimated degradation degree.

The compensation data generator 123 supplies the generated compensation data CDATA to the compensator 124. The compensator 124 compensates the image data DATA based on the compensation data CDATA supplied from the compensation data generator 123, and supplies the compensated image data DATA' to the timing controller 130.

Figure 6:
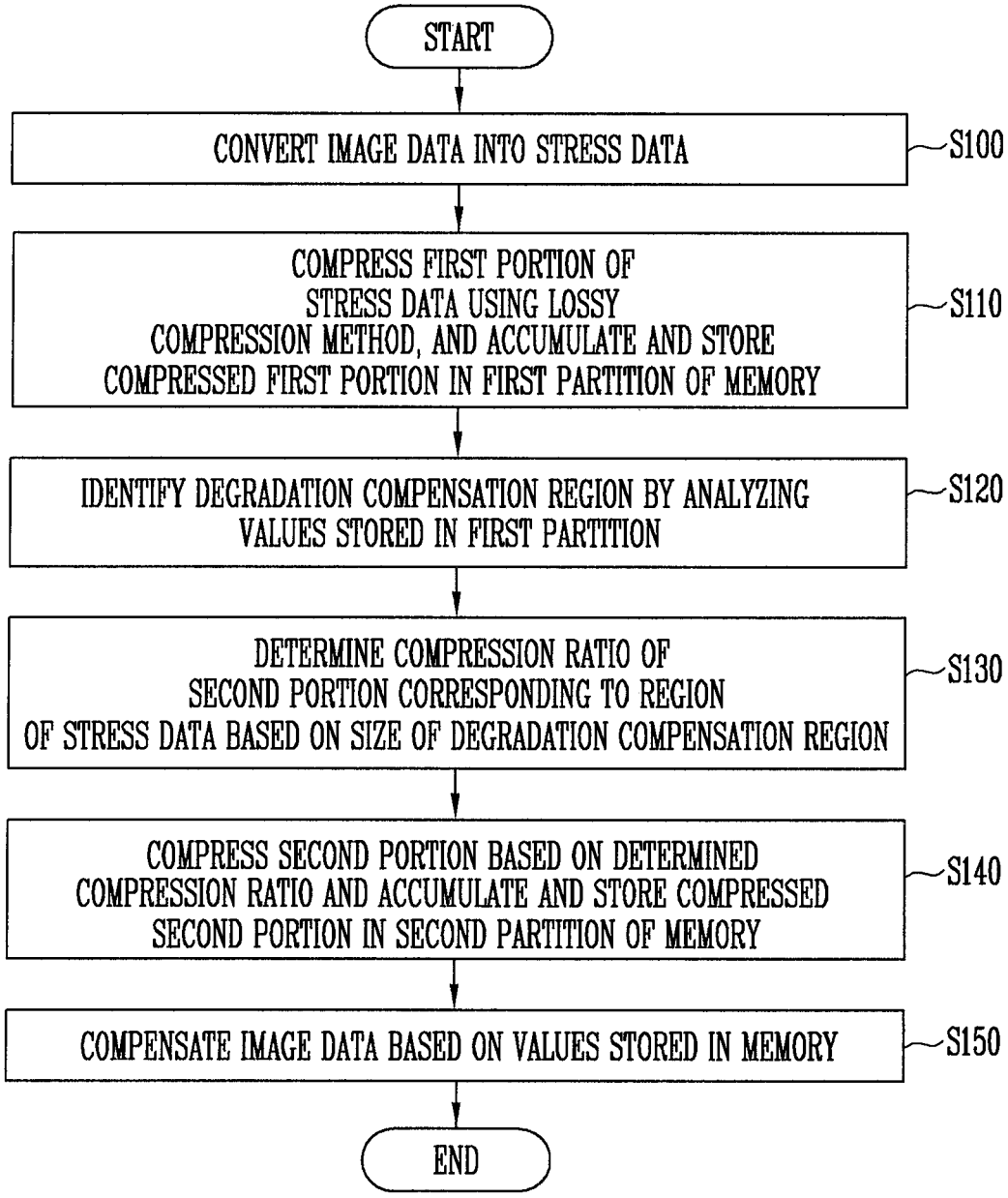
FIG. 6 is a flowchart illustrating a method for driving the organic light emitting display shown in FIG. 1.

FIG. 6 is a flowchart illustrating a method for driving the organic light emitting display 100 shown in FIG. 1.

Referring to FIG. 6, the data accumulator 110 generates stress data SDATA by converting gray scale values included in image data DATA into stress values (S100). For example, the gray-stress converter 111 may convert gray scale values (or gray levels) into stress values by mapping each gray scale value using a set or predetermined mapping table.

The data accumulator 110 compresses a first portion of the stress data SDATA not corresponding to a degradation compensation area using a set or predetermined lossy compression method, and accumulates and stores the compressed first portion of the stress data SDATA in the first partition of the memory 115 (S110). For example, the data accumulator 110 may divide the display unit 160 into a plurality of blocks, and transform values corresponding to each of the blocks into a frequency region. The data accumulator 110 extracts only set or predetermined frequency components in the frequency region, and accumulates the extracted frequency components in the first partition of the memory 115.

The data accumulator 110 identifies the degradation compensation region by analyzing the values stored in the first partition of the memory 115 (S120). For example, the data accumulator 110 may identify any block (from among the plurality of blocks) in which the sum of high-frequency components in the frequency region exceeds a reference value to be part of the degradation compensation region.

The data accumulator 110 determines a compression ratio based on the size of the degradation compensation region (S130). For example, the data accumulator 110 may determine the compression ratio based on the number of blocks identified as the degradation compensation region.

The data accumulator 110 compresses a second portion of the stress data SDATA corresponding to the degradation compensation region based on the compression ratio, and accumulates and stores the compressed second portion in the second partition of the memory 115 (S140).

The data compensator 120 compensates the image data DATA based on the values stored in the memory 115, i.e., the accumulated data ADATA (S150). For example, the data compensator 120 may calculate compensation values with respect to the pixels 170 based on the accumulated data ADATA, and compensates the image data DATA based on the calculated compensation values.

As described above, in embodiments of the organic light emitting display and method for driving the organic light emitting display according to the present invention, stress data corresponding to the light emission amount of the pixels is efficiently accumulated and stored, thereby decreasing required memory capacity. Further, it is possible to increase the accuracy of compensation with respect to a degradation compensation region that benefits especially from relatively accurate compensation.

By way of summation and review, an organic light emitting diode degrades corresponding to its cumulative light emission time and luminance (current amount) as time elapses and therefore, the light emission efficiency of the organic light emitting diode deteriorates. As the light emission efficiency of the organic light emitting deteriorates, a reduction in luminance occurs. This reduction in luminance may vary with each pixel since pixels normally display with different accumulated light emissions times or luminance. Accordingly, the image quality may deteriorate due to the occurrence of image sticking. The image quality may be partially or completely restored by appropriately compensating for degradation of the pixels according to the accumulated light emission amount of each pixel.

In embodiments of an organic light emitting display and a method for driving the organic light emitting display according to the present invention, stress data corresponding to the light emission amount of the pixels is efficiently accumulated and stored, thereby decreasing the memory needed to store the accumulated stress data. Further, it is possible to increase the accuracy of compensation with respect to a degradation compensation region (of the display unit) that benefits more from relatively accurate compensation than do other regions of the display unit.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims and their equivalents.

What is claimed is:

1. An organic light emitting display comprising: a display unit configured to be driven by image data;

a data accumulator configured to compress and accumulate first data corresponding to a first portion of the image data for driving a first region of the display unit, identify a second region of the display unit from the first region by analyzing the accumulated first data, and compress and accumulate second data corresponding to a second portion of the image data for driving the second region with a compression ratio based on a size of the second region; and a data compensator configured to compensate the image data based on the accumulated first and second data, wherein the data accumulator comprises:

a controller configured to identify the second region by analyzing the accumulated first data, and determine the compression ratio based on the size of the second region;

a gray-stress converter configured to generate the first and second data by converting gray levels included in the first and second portions of the image data into stress values constituting the first and second data, respectively;

a first compressor configured to compress the first data using a lossy compression method;

a second compressor configured to compress the second data based on a compression ratio; and a memory configured to accumulate and store the compressed first and second data as the accumulated first and second data, respectively.

2. The organic light emitting display of claim 1, wherein the gray-stress converter is further configured to convert the gray levels into the stress values by mapping each of the gray levels to a corresponding one of the stress values using a mapping table.

3. The organic light emitting display of claim 1, wherein the first compressor is further configured to compress the first data by dividing the display unit into a plurality of blocks, transforming ones of the stress values corresponding to each of the blocks into a frequency region comprising a plurality of frequency components, and extracting ones of the frequency components.

4. The organic light emitting display of claim 3, wherein the controller is further configured to incorporate one of the blocks into the second region when a sum of high-frequency ones of the frequency components in the frequency region of the one of the blocks exceeds a reference value.

5. The organic light emitting display of claim 4, wherein the controller is further configured to control the compression ratio based on a number of the blocks incorporated into the second region.

6. The organic light emitting, display of claim 1, wherein the second compressor is further configured to compress the second portion using one of a plurality of compression units that compress the second portion with a corresponding plurality of different compression ratios, as selected by the controller.

7. The organic light emitting display of claim 1, wherein a compression ratio of the first compressor is greater than the compression ratio of the second compressor.

8. The organic light emitting display of claim 1, wherein the data compensator is further configured to calculate compensation values with respect to pixels based on the accumulated first and second data, and compensate the image data based on the calculated compensation values.

9. A method for driving an organic light emitting display comprising a display unit, the method comprising:

generating first data by converting gray levels included in a first portion of image data into stress values, the first portion for driving a first region of the display unit;

compressing the first data using a first compression method, and accumulating and storing the compressed first data in a first partition of a memory;

identifying a second region of the display unit from the first region by analyzing values stored in the first partition;

determining a compression ratio based on a size of the second region;

generating second data by converting gray levels included in a second portion of the image data into stress values, the second portion for driving the second region of the display unit;

compressing the second data based on the determined compression ratio, and accumulating and storing the compressed second data in a second partition of the memory;

compensating the image data based on values stored in the memory;

identifying the second region by analyzing the accumulated first data, and determining the compression ratio based on the size of the second region;

generating the first and second data by converting gray levels included in the first and second portions of the image data into stress values constituting the first and second data, respectively;

compressing the first data using a lossy compression method;

compressing the second data based on the compression ratio; and accumulating and storing the compressed first and second data as the accumulated first and second data, respectively.

10. The method of claim 9, wherein the generating of the first and second data comprises converting the gray levels into corresponding said stress values by mapping each one of the gray levels to a corresponding one of the stress values using a mapping table.

11. The method of claim 9, wherein the accumulating and storing of the compressed first data in the first partition of the memory comprises: dividing the display unit into a plurality of blocks;

transforming ones of the stress values corresponding to each of the blocks into a frequency region comprising a plurality of frequency components;

extracting ones of the frequency components in the frequency region; and accumulating the extracted frequency components in the first partition of the memory.

12. The method of claim 11, wherein the identifying of the second region further comprises incorporating one of the blocks into the second region when a sum of high-frequency ones of the frequency components in the frequency region of the one of the blocks exceeds a reference value.

13. The method of claim 12, wherein the compression ratio is based on a number of the blocks incorporated into the second region.

14. The method of claim 9, wherein the compensating of the image data comprises: calculating compensation values with respect to pixels based on the values stored in the memory; and compensating the image data based on the calculated compensation values.

* * * * *